US006003198A

United States Patent [19]

Stegens

[11] Patent Number: 6,003,198

[45] Date of Patent: Dec. 21, 1999

[54] BRUSHROLL

[75] Inventor: Alfred H. Stegens, Olmsted Township, Ohio

[73] Assignee: The Scott Fetzer Company, Westlake, Ohio

[21] Appl. No.: 09/127,674

[22] Filed: Jul. 31, 1998

[51] Int. Cl.[6] ..... A47L 5/10

[52] U.S. Cl. ..... 15/392; 15/179; 15/389

[58] Field of Search ..... 15/41.1, 179, 182, 15/383, 389, 391, 392

[56] References Cited

U.S. PATENT DOCUMENTS 1,559,830 11/1925 Woodall ..... 15/392
1,999,696 4/1935 Kitto ..... 15/392
5,193,243 3/1993 Stegens .
5,272,785 12/1993 Stegens .
5,373,603 12/1994 Stegens .
5,435,038 7/1995 Sauers ..... 15/392
5,465,451 11/1995 Stegens .
5,598,600 2/1997 Stegens .

*Primary Examiner*—Terrence R. Till
*Attorney, Agent, or Firm*—Watts, Hoffmann, Fisher & Heinke, Co., L.P.A.

[57] ABSTRACT

A brushroll having a pulley driven spindle with an end assembly at each end rotatably mounting the spindle in a vacuum cleaner nozzle. On the pulley end of the spindle, a projecting pin is knurled at one end and inserted into the end of the spindle. An outboard portion of the pin is threaded. The knurling on the pin forms an abutment shoulder outboard of the end of the spindle. The drive pulley is threaded onto the threaded end of the pin until it contacts a bearing and presses it against the abutment shoulder, so as to prevent the pin from being jacked out of the spindle when the pulley is threaded onto the pin.

9 Claims, 2 Drawing Sheets

BRUSHROLL

TECHNICAL FIELD

The present invention relates generally to vacuum cleaners, and more specifically to a vacuum cleaner brushroll having a pulley end assembly that improves the performance and durability of the brushroll.

BACKGROUND

A conventional form of brushroll comprises a wood spindle which carries a plurality of tufts of bristles or beater bar elements. The brushroll is rotatably supported at both ends by end assemblies mounted in the vacuum cleaner nozzle. Each end assembly includes a disk carried on the end of the spindle, a pin fixed to the spindle and projecting from its end through the disk, a bearing having its inner race fixed on the projecting end of the pin, and an end cap having a pocket that receives the outer race of the bearing. The end caps mount the spindle for rotation in the nozzle of the vacuum cleaner. In a belt driven spindle arrangement, one of the pins extends through an end cap and a pulley is threaded onto the pin so that the spindle can be rotated by a belt connected to the vacuum cleaner motor.

In a known construction over which the present invention is an improvement, one end of the pin that carries the pulley is knurled and is frictionally engaged in a hole in the spindle. The knurling on the pin stops short of the outer face of the end cap. During assembly, the pulley would be threaded onto the end of the pin until the bearing was captured between the pulley and the disk at the end of the spindle. With the prior art design, it was possible to continue to thread the pulley on the pin. Since the bearing was already engaged with the plastic disk, this continued threading of the pulley would withdraw the pin endwise from the hole in the spindle.

The movement of the pin caused by overthreading the pulley onto the pin would unbalance the brushroll which typically rotates at speeds of 5500–6000 rpm. The unbalanced condition results in eccentric rotation. The pin would wobble in the hole of the spindle and enlarge it, which results in brushroll rattle and general unsatisfactory operation.

The problem is accentuated when large die cast pulleys are used. The larger die cast pulleys are themselves unbalanced. As the pin supporting the pulley is withdrawn from the hole, the unbalanced large pulleys accentuate wobbling of the pin.

SUMMARY OF THE INVENTION

The present invention is an improvement of the construction generally described above, and features a pin construction which prevents the pin from being inadvertently jacked out of the spindle hole by overthreading of the pulley.

More particularly, the invention is an improvement of a vacuum cleaner roll assembly of the type including a spindle, pins fixed to the spindle and projecting from its ends, end caps, bearings having inner races mounted on the pins, and a pulley at one end of the spindle for rotating it. The improvement comprises a positive stop on the pin which carries the pulley, the stop being adjacent the inner race of the associated bearing. The pulley is threaded onto the pin to capture the bearing between the pulley and the stop.

With this construction, it is not possible to jack the pin out of the spindle hole when the pulley is threaded onto the pin. The pulley can be threaded onto the pin only to the point where the bearing is firmly held between the pulley and the stop. At this point, it is not possible to rotate the pulley further and thereby cause pin movement.

Other objects and advantages and a fuller understanding of the invention will be had from the following detailed description of the preferred embodiments and the accompanying drawings.

DESCRIPTION OF PREFERRED EMBODIMENT

Figure 1:
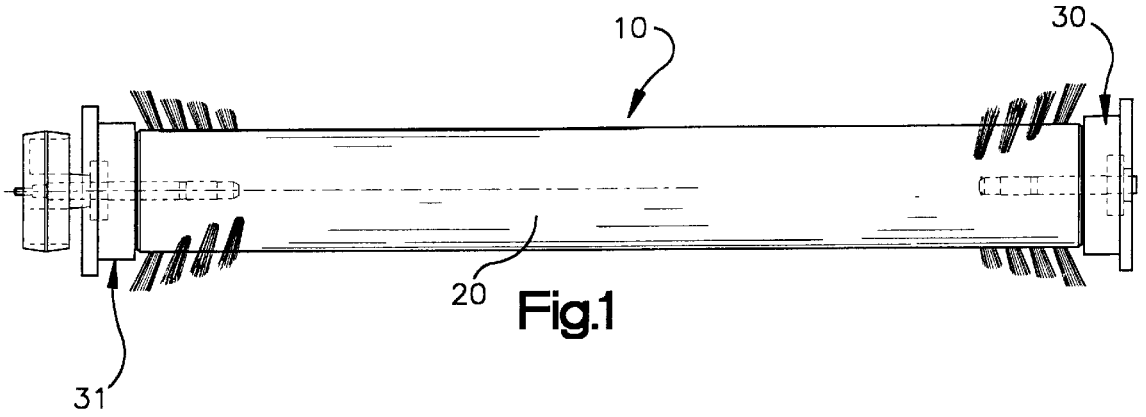
FIG. 1 is a side elevational view showing a preferred brushroll according to the present invention with tufts omitted for clarity.

A brushroll 10 according to the present invention is shown in FIG. 1. The brushroll 10 consists of a spindle 20 rotatably supported at each end by end assemblies 30 and 31. Each end assembly is mounted in a vacuum nozzle (not shown) to position the brushroll 10.

Figure 3:
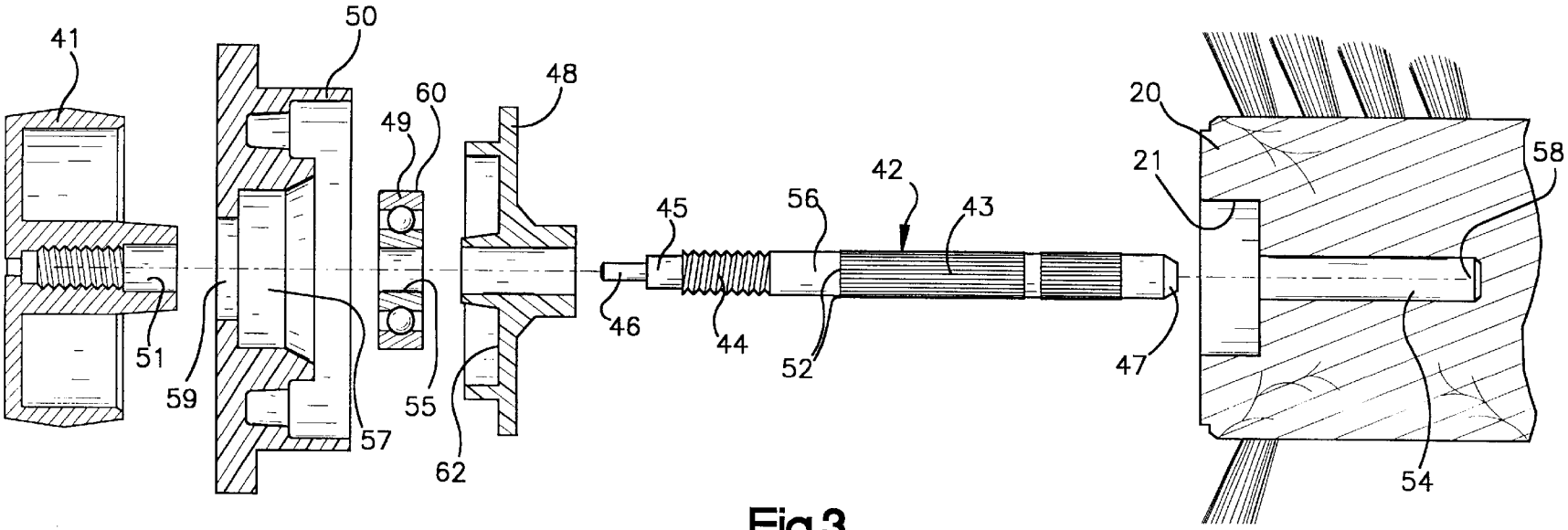
FIG. 3 is an exploded view of the pulley end assembly of the brushroll.

FIG. 3 shows an exploded view of the pulley side end assembly 31 which includes a drive pulley 41 and its connection to the spindle 20. The end of the spindle 20 is countersunk as indicated by reference numeral 21 and contains a hole 54.

Figure 2:
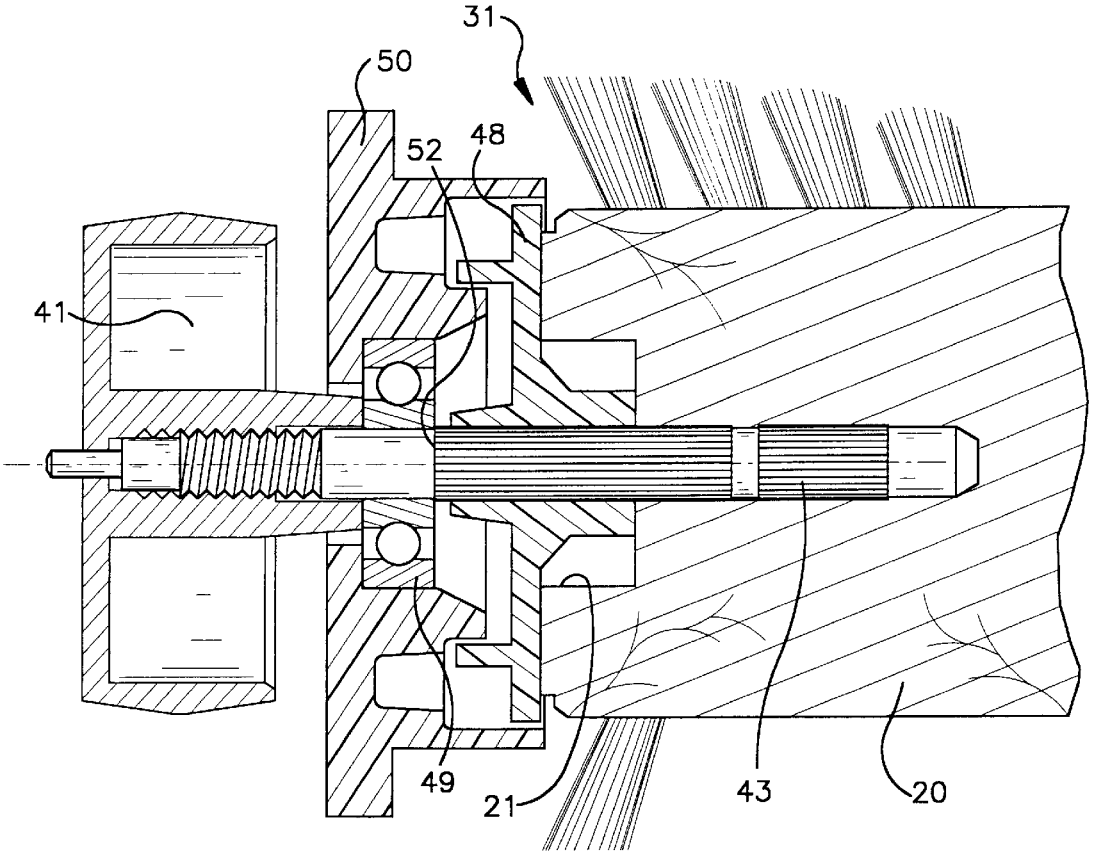
FIG. 2 is an enlarged fragmentary elevational view of the pulley end assembly of the brushroll.

A pin 42 has a knurled portion 43, a journal portion 56, an abutment shoulder 52 formed between the knurled portion and the journal portion, a threaded portion 44, a second shoulder 45 and an end extension 46. The pin 42 is inserted into the hole 54 until the end 47 of the pin seats in the bottom end 58 of the hole. When the pin 42 is completely seated in the hole 54, a part of the knurled portion 43 of the pin protrudes from the spindle 20. See FIG. 2 for a view of the assembled pulley side end assembly 31.

A bearing 49 having an inner race 55 and an outer race 60 is disposed on the pin 42 between the pulley 41 and the spindle 20. The bearing 49 is enclosed between an end assembly disk 48 and an end cap 50. The end assembly disk 48 slides onto the pin 42 and has a force fit on the knurled portion 43 of the pin. The bearing 49 slides over the pin 42 and rests against the abutment shoulder 52 of the pin and is loosely enclosed in the bearing receiving pocket 62 of the end assembly disk 48. The bearing 49 is prevented from further movement toward the spindle 20 by the abutment shoulder 52 so that the entire bearing inner race 55 is located around the pin journal portion 56. The end cap 50 slides over pin 42 and receives the outer race 60 of the bearing 49 in its bearing receiving pocket 57.

A pulley 41 has a threaded cavity 51. The pulley 41 is threaded onto the threaded portion 44 of the pin through an end cap opening 59 until it contacts the bearing 49. The threaded portion 44 is reverse threaded so that rotation of the pulley serves to tighten the pulley against the bearing 49. The bearing 49 limits the threading of the pulley 41 onto the pin 42 by its engagement with the abutment shoulder 52. The bearing inner race 55 is therefore firmly engaged between the pulley 41 and the abutment shoulder 52. Any attempt to over thread the pulley 41 onto the pin 42 is thereby prevented by the engagement of the bearing inner race 55 and the abutment shoulder 52, making it impossible to inadvertently jack the pin 42 out of the spindle 20.

Many variations and modifications of the invention will be apparent to those skilled in the art from the above detailed description. Therefore, it is to be understood that, within the scope of the appended claims, the invention can be practiced otherwise than as specifically shown and described.

I claim:

1. In a vacuum cleaner spindle assembly including a spindle, pins projecting from the ends of said spindle, end caps, and bearings having inner races fitted on said pins, the improvement comprising a positive stop on one of said pins, said one pin having a threaded end portion outboard of said stop, and a pulley threaded on said threaded end portion, whereby said stop prevents endwise movement of said pin by threading said pulley onto said end portion.

2. In a vacuum cleaner spindle assembly including a spindle, disks carried by said spindle at its ends, pins projecting from the ends of said spindle through said disks, end caps having bearing receiving pockets, and bearings having inner races fitted on said pins and outer races fitted in said bearing receiving pockets, the improvement comprising a positive stop on one of said pins engagable by the inner race of the bearing on said one pin, said one pin having a threaded end portion outboard of said stop, and a pulley threaded on said threaded end portion to press the inner race of the adjacent bearing against said stop.

3. The improvement as claimed in claim 1 or claim 2 wherein said positive stop is an abutment shoulder.

4. The improvement as claimed in claim 3 wherein said abutment shoulder is formed by knurling extending axially on said one pin.

5. The improvement as claimed in claim 4 wherein said one pin is fixed in the end of said spindle by said knurling.

6. The improvement as claimed in claim 2 wherein said pulley has a threaded socket that receives the threaded end portion of said one pin, and wherein said one pin has a second shoulder outboard of its threaded portion which is spaced from the bottom of said threaded socket when said inner race is held in place by said positive stop.

7. The improvement as claimed in claim 6 wherein said one pin has an end extension outboard of said second shoulder, said end extension projecting through said pulley and terminating adjacent its outer face.

8. In a power actuated vacuum cleaner roll assembly including a spindle, disks carried by said spindle at its ends, pins fixed in the ends of said spindle by axial knurling, said pins projecting from the ends of said spindle through said disks, end caps, bearings having inner races fitted on said pins, and a pulley carried on one pin for rotating said spindle, the improvement comprising:

an abutment shoulder on said one pin adjacent the outer face of the associated disk;

a reverse threaded portion on said one pin outboard of said shoulder, said pulley being threaded on said threaded portion, whereby rotation of said pulley acts to tighten it against the bearing without pulling said one pin endwise from said spindle.

9. The improvement as claimed in claim 8 wherein said pulley has a threaded socket that receives the threaded portion of said one pin, said one pin has a second shoulder outboard of said threaded portion and spaced from the bottom of said threaded socket when said pulley is tightened against said bearing shoulder, and wherein said one pin has an end extension outboard of said second shoulder, said end extension projecting through said pulley and terminating adjacent its outer face.

* * * * *